United States Patent [19]

Kawasoko et al.

[11] 4,202,537

[45] May 13, 1980

[54] APPARATUS FOR ANNEALING STRIP COILS

[75] Inventors: Yoshiaki Kawasoko, Chigasaki; Iwane Chiba, Soka; Noboru Yamazaki; Toshimi Chiyonobu, both of Fukuyama; Masao Shikuma, Kamakura, all of Japan

[73] Assignee: Nippon Kokan Kabushiki Kaisha, Tokyo, Japan

[21] Appl. No.: 905,547

[22] Filed: May 12, 1978

Related U.S. Application Data

[62] Division of Ser. No. 753,907, Dec. 23, 1976, abandoned.

[30] Foreign Application Priority Data

Dec. 25, 1975 [JP] Japan ..... 50-153930

[51] Int. Cl.[2] ..... C21D 9/00

[52] U.S. Cl. ..... 266/252

[58] Field of Search ..... 266/251, 252; 148/155

[56] References Cited

U.S. PATENT DOCUMENTS 3,756,868 9/1973 Bloom ..... 148/155

*Primary Examiner*—R. Dean

*Attorney, Agent, or Firm*—Moonray Kojima

[57] ABSTRACT

In a continuous annealing process, the annealing furnace is comprised of two adjacent chambers, one for heating and the other for cooling with a door therebetween. The strip coil to be annealed is brought into the heating chamber, such as by a vehicle on a rail, the heating chamber closed, and the coil heated. After heating, the interconnecting door is opened and the heated coil is moved into the cooling chamber by the vehicle, the cooling chamber is closed and the coil is cooled. Concurrently, the next charge of coil is moved into the heating chamber and heated. Since heat from the previous cycle is still in the heating chamber, the amount of heat required for the next cycle is less and heating efficiency is substantially increased. Also, no movement of other equipment is necessary since only a horizontally movable vehicle is necessary to move the coil from one chamber to the next.

4 Claims, 4 Drawing Figures

APPARATUS FOR ANNEALING STRIP COILS

This is a division of application Ser. No. 753907, filed Dec. 23, 1976, now abandoned.

BACKGROUND OF THE INVENTION

This invention relates to a continuous annealing process for metals, such as cold reduced steel, strip coil and the like, and more particularly to such a method having increased heating efficiency, increased productivity and simplicity and apparatus therefor.

Generally, for example, cold reduced strip coils are annealed in a batch box type furnace wherein the coils are charged as a tight or open coil in a single stack or in multiple stacks. It is well known, that there are many difficulties in prior art annealing equipment and progress in improvements has been slow and in small steps, with, however, each small step being significant. Prior art methods and apparatus have various deficiencies and difficulties of operation of the furnace and handling of the coils to be annealed and after annealing. Consequently, there are considerable deficiencies and problems in addition to non-uniformity of annealing operations. For example, many of the difficulties in operation of the furnace are encountered because both the heating and cooling of the coils are performed in the same fixed furnace chamber. One difficulty is due to the construction of the annealing furnace, which roughly comprises a base, an outer cover, an inner cover, and other attached equipment. Some of the above parts must be re-arranged at the time of cooling of the fully heated coils from their positions used for the heating cycle. This is usually done by a crane. Disadvantageously, such method results in inefficiencies of heating and loss of production time. For example, the heat for the heating cycle is lost after the heating cycle and also added energy is necessary to cool the coil in the same chamber.

Moreover, such a method requires furnances which are disposed close together in a narrow annealing yard. Thus, the coils to be annealed and the coils already annealed are usually placed in overcrowded areas. Consequently, the coils tend to become damaged. Furthermore, there are other difficulties, such as sticking together of the stacked coils due to increase of coil weight, difficulty in arranging the treatment of combusion expelled gases, etc. Thus, the operation of prior furnaces and controlling of coils are plagued by various problems and inefficiencies.

Various counter-measures have been proposed and used in the prior art. An example is the so-called "U.A.D." system by Lee Wilson Company, Ltd. This system does not use a crane, and instead opens and closes a door to a single furnace chamber in which both the heating and cooling are carried out. Through the door, the coil is charged using a cart. But, this prior art system uses the same chamber to both heat and cool; thus, the prior art problems of low productivity and low heating efficiency are still present and unresolved.

SUMMARY OF THE INVENTION

Accordingly, an object of the invention is to resolve the aforementioned and other problems of the prior art, and to simplify and improve the continuous annealing of, for example, strip coils.

Another object is to improve the heating efficiency and productivity of the annealing process.

The foregoing and other objects of the invention are attained in a process and apparatus which briefly encompasses a two chambered annealing furnace, one chamber being a heating chamber, and the other chamber being a cooling chamber and located horizontally adjacent to the heating chamber with an interconnecting door therebetween. In operation, a coil to be annealed is placed in the heating chamber, the chamber is sealed, and heat is applied to the coil. When fully heated, the interconnecting door is opened and the coil is moved into the cooling chamber, the interconnecting door is closed and the cooling chamber sealed, and the coil is cooled. Concurrently, another coil may be placed in the heating chamber and heated. The heat remaining from the prior heating cycle is retained and hence the next heating cycle does not require as much energy to heat and hence heating efficiency is substantially improved. The steps are repeated continually and a plurality of coils are annealed. The coils may be placed on a cart on rails laid on the floors of the chambers hence the only movement of parts is the opening and closing of the doors to the chambers and the horizontal movement of the carts. Advantageously, none of the equipment need be moved to accomplish heating and cooling. Thus, productivity is substantially increased.

A feature of the invention is a single annealing furnace divided into two adjacent and separate chamber, a heating chamber, a cooling chamber and an interconnecting door therebetween, wherein a coil is first fully heated in the heating chamber, and then moved through the interconnecting door, which is opened after the heating cycle, into the cooling chamber wherein the coil is cooled, and another coil is charged into the heating chamber just vacated by the fully heated coil and in which heat still remains, thereby effecting concurrent cooling of a previously heated coil and the heating of the next coil in an adjacent chamber.

Another feature is the method of annealing in which heating is accomplished in one chamber and then immediately cooled in an adjacent separate chamber by passage of a vehicle containing the melt to be annealed through a door disposed therebetween.

DETAILED DESCRIPTION OF PREFERRED EMBODIMENTS

Figure 1:
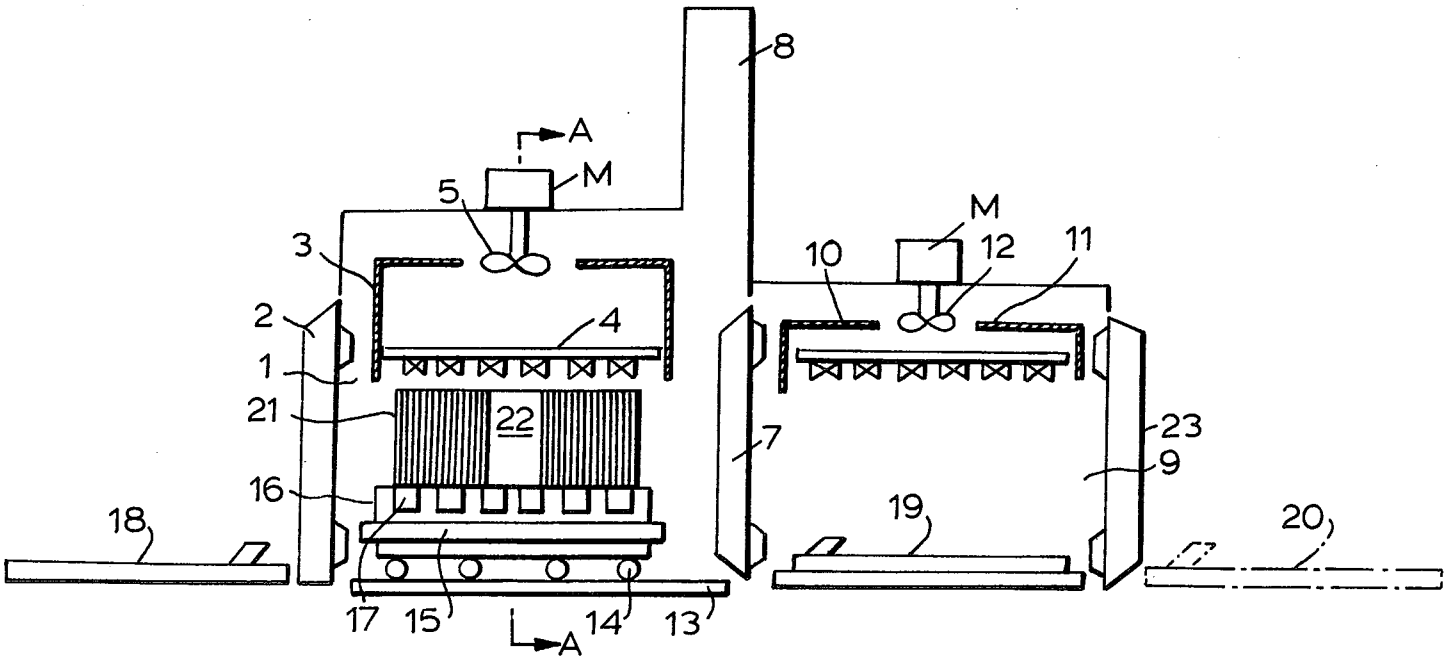
FIG. 1 depicts an elevational side view of an illustrative embodiment.
Figure 2:
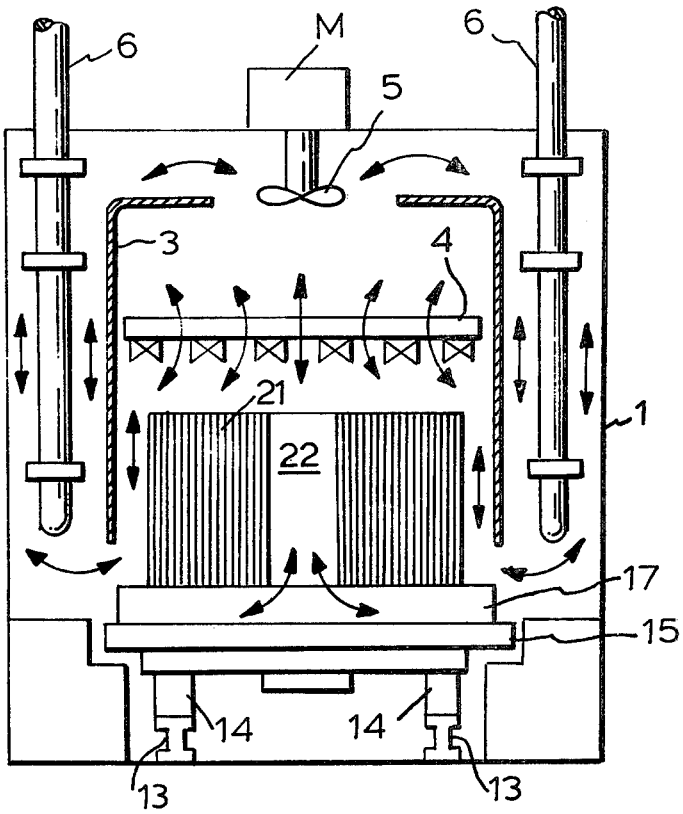
FIG. 2 is a partial sectional view taken along A—A of FIG. 1.

Turning now to FIG. 1, the inventive system comprises a heating chamber 1, a cooling chamber 9 directly adjacent to the heating chamber 1, and a communicating door 7 disposed therebetween. Heating chamber 1 comprises a charging door 2, an inner cover 3, a rectifying plate 4, a fan 5, and a motor M. Motor M provides rotary power to turn fan 5, and create and assist circulation of convection currents of heating gases. In FIG. 2, there is shown the heating element employed, radiator tubes 6, located in chamber 1. Heat from tubes 6 is then circulated with assistance of fan 5, in a manner, such as shown in FIGS. 2 and 3, about the coils and other parts disposed in the respective chambers. The outer structures of chamber 1 has an open space 8 to hold door 7 in the open position.

The strip coils 21 are loaded into truck or vehicle 15 for placement in the heating and cooling chambers as depicted. The vehicle 15, having wheels 14, is placed on rails 13 which are laid on the floors of the two chambers as depicted. Furthermore, on vehicle 15 is a support 16, having a plurality of grooves 17. This enables good circulation of gases about the coils 21. The vehicle 15 is moved by means of traction apparatus 19,19,20 with motors and auxiliary equipment not shown. Thus, the coil to be annealed is placed on the truck bed support 16 and moved horizontally on rails 13 into the heating chamber 1 and then into the cooling chamber 9. Accordingly, movement is horizontal and aside from movement of doors 2,7 and 23, none of the other equipment need be moved.

The cooling chamber 9 is disposed adjacent to the heating chamber 1 and connected thereto via communicating door 7. The cooling chamber 9 comprises a discharge door 23, an inner cover 10, rectifying plates 11, motor M and fan 12. The motor M is used for the same purpose as motor M of the heating chamber 1, namely, to drive fan 12 and cause and assist circulation of convection currents of cooling gases. The rectifying plates 4 and 11 have holes therein (see FIG. 2) for improve circulation of gases. Inner covers 10 and 3 enable more efficient thermal insulation and protection of the outer covers.

In operation, door 2 is opened, truck 15 is loaded with strip coil 21, and then run into chamber 1 through open door 2 on rails 13 by movement of the traction device 18.. Then, charging door 2 is closed and door 7 is also closed. Then, for example, $N_2$ purge of the heating chamber 1 is carried out before raising the temperature of the heating chamber 1 so that the amount of oxygen in the chamber is lowered to about 10 ppm or less. Then, radiator tubes 6 are operated to raise the temperature of the chamber 1 and provide heating of the strip coils 21. Advantageously, if the prior heating cycle has just been concluded, the heat will still remain in the chamber 1. The next heating cycle will thus require only added heat and will be very effective in raising the temperature, that is, the heating efficiency is improved substantially. The heat from the previous cycle is not expelled or eliminated as inthe prior art. Instead, the heat from the previous heat cycle is used to increase the heat efficiency.

Figures 3A, 3B:
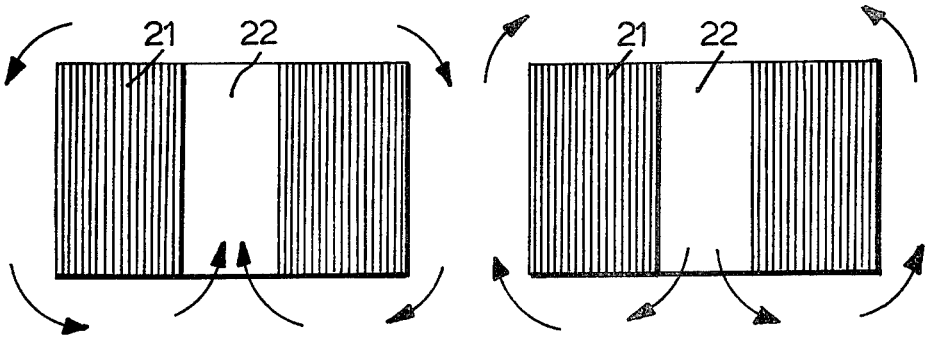
FIGS. 3A and 3B depict the convection current pattern about the coils in both the heating chamber and the cooling chamber.

When heat is applied, motor M is also turned on to cause fan 5 to rotate and cause the circulation of convection current in the manner shown in FIGS. 3 and 2, around coil 21. The convection current is circulated through inner cover 3, rectifying plate 4, grooves 17 and inner hole 22 of coil 21, so that the loaded coil 21 is heating uniformly. The convection current in such a case becomes either an upward flow (see FIG. 3A) or a downward flow (see FIG. 3B) as viewed from the center hole 22 of coil 21. Consequently, even if either the upward flow or downward flow is selected, the resulting effect is the same.

After fully heating the coil 21, door 7 is opened, and the truck 15 is moved by traction device 19 from chamber 1 into the chamber 9, for cooling. Then door 7 is closed and door 23 is also closed.

The cooling is then started. In cooling chamber 9, a cooler device, not shown, is arranged in the cooling chamber 9, such as in the same location as the radiator tubes in chamber 1. When operated, the cooler will fully cool the coil 21. The convection current pattern is similar to that discussed for chamber 1, and can be seen in FIG. 2, and around the coil in FIG. 3. In such a case, an important consideration is the amount of oxygen in the cooling atmosphere. It has been found, that about 10 ppm of oxygen being allowed in the heating chamber 1, causes the coil 21 to oxidize. Accordingly, oxygen in the cooling chamber 9 should be preferably adjusted to less than 2 ppm. These phenomena are based on the temperature of the atmospheric gas, and may vary for the other variable circumstances. Thus, in an atmosphere of less than 2 ppm oxygen, there was no oxidized film.

After sufficient cooling, door 23 is opened and coil 21 is discharged by movement of vehicle 15 via traction device 19 traveling in the direction shown by dotted lines 20. After coil 21 is discharged from chamber 9, the cooling chamber 9 is, for example, purged with $N_2$ gas to reduce the oxygen level to less than 2 ppm and then atmospheric gas, for example $H_2N_2$, is introduced.

Concurrently, with the cooling operation, another coil to be annealed may be moved into the heating chamber 1 as discussed above, with door 7 closed. Then door 2 is closed and heat is again applied. Thus, the heating cycle for the next charge is taking place in heating chamber 1 concurrently with the cooling of the previously heated coil in the adjacent separate chamber. The cycle of heating, cooling for each charge is then repeated. The heat remaining from the previous charge is utilized in the next heating cycle and since very little heat is lost, heating efficiency is remarkably improved.

The following is one example of an apparatus based on the invention.

Strip Coil—diameter, 2340 mmϕ; width, 1270 mm; weight, 26 tons.

Capacity of Fan (in chambers)—heating chamber, 37 KW; volume of flow, 1000 $m^3$/min (1040 rpm); cooling chamber, 75 KW; volume of flow, 1400 $m^3$/min (1150 rpm); either fan is able to produce an upward or downward flor of gases through the center of the coil.

Chamber capacity—heating chamber, 55 $m^3$; cooling chamber, 65 $m^3$.

Radiator tubes—flow rate of COG, 280 N $m^3$/hr; combusion quantity, $10^6$ Kcal/hr.

Cooler—heat exchanger arranged on both sides of cooling chamber; amount of cooling water, 1100 1/min.

Coil moving device—size 2700 mm × 3800 mm; moving speed, 20 m/min.

Atmospheric gas—$N_2$ for purging $O_2$; heat chamber 480 $m^3$/hr and cooling chamber, 550 $m^3$/hr; and $H_2N_2$, 150 $m^3$/hr.

The results were highly satisfactory in achieving the objects of the invention.

The foregoing description is illustrative of the principles of the invention. Numerous other variations and modifications thereof would be apparent to the worker skilled in the art. All such variations and modifications are to be considered to be within the spirit and scope of the invention.

What is claimed is:

1. Apparatus for annealing strip coils, comprising

A. a single heating chamber comprising i. an inner cover, ii. means for circulating heated gases within said heating chamber, iii. a first passageway located at one end of said heating chamber, iv. a movable door for opening and closing said first passageway, v. a second passageway located at an end opposite to said first end for moving said coils out of said heating chamber, vi. means for raising the temperature in said heating chamber to thereby heat the gases therein and uniformly heat said coils in said heating chamber, and vii. means for moving said coils to be anealed in and out of said heating chamber;

B. a single chamber located adjacent to said heating chamber comprising i. an inner cover, ii. means for circulating cooled gases within said cooling chamber, iii. a first passageway disposed connected to said second passageway of said heating chamber for moving said heated coils into said cooling chamber from said heating chamber, iv. a second passageway located at an end opposite to said first passageway for moving cooled coils out of said cooling chamber, v. movable door for opening and closing said second passageway, vi. means for cooling said gases within said cooling chamber thereby to uniformly cool said coils in said cooling chamber, and vii means for moving said coils in and out of said cooling chamber; and C. movable door means for concurrently opening or closing said second passageway of said heating chamber and said first passageway of said cooling chamber.

2. The apparatus of claim 1, wherein said heating chamber and said cooling chamber have rectifying plates within the inner cover, and means for circulating gases comprising a motor and a fan in each chamber.

3. The apparatus of claim 1, wherein said means for moving comprises rail means on the floors of said heating chamber and said cooling chamber, vehicle means having circulation support means for loading said coils, and traction means for moving said vehicle on said rails.

4. The apparatus of claim 1, wherein said heating chamber has a space for holding said door for said second passageway of said heating chamber in the open position.

* * * * *